US006899167B2

(12) United States Patent
Martins et al.

(10) Patent No.: US 6,899,167 B2
(45) Date of Patent: May 31, 2005

(54) HEAT-EXCHANGE MODULE, ESPECIALLY FOR A MOTOR VEHICLE

(75) Inventors: Carlos Martins, Montfort L'Amaury (FR); Gérard Gille, Paray Vielle Poste (FR); Stéphane Avequin, Versailles (FR); Michel Potier, Rambouillet (FR)

(73) Assignee: Valeo Thermique Moteur, La Verriere (FR)

( * ) Notice: Subject to any disclaimer, the term of this patent is extended or adjusted under 35 U.S.C. 154(b) by 503 days.

(21) Appl. No.: 09/794,396

(22) Filed: Feb. 28, 2001

(65) Prior Publication Data

US 2001/0047860 A1 Dec. 6, 2001

(30) Foreign Application Priority Data

Feb. 28, 2000 (FR) ..... 00 02453

(51) Int. Cl.[7] ..... F28D 7/10

(52) U.S. Cl. ..... 165/140; 165/144; 165/149; 165/152; 165/153; 165/175; 165/181

(58) Field of Search ..... 165/140, 144, 165/152, 153, 175, 181

(56) References Cited

U.S. PATENT DOCUMENTS

| | | | | | |
|---|---|---|---|---|---|
| 2,540,339 | A | * | 2/1951 | Kritzer | 165/151 |
| 3,757,856 | A | * | 9/1973 | Kun | 165/166 |
| 3,780,799 | A | | 12/1973 | Pasternak | |
| 4,144,933 | A | * | 3/1979 | Asselman et al. | 165/124 |
| 4,351,389 | A | * | 9/1982 | Guarnaschelli | 165/141 |
| 4,369,350 | A | | 1/1983 | Kobayashi et al. | |
| 4,401,154 | A | * | 8/1983 | Anders et al. | 165/151 |
| 4,428,419 | A | * | 1/1984 | Dubrovsky et al. | 165/151 |
| 4,492,851 | A | * | 1/1985 | Carr | 219/201 |
| 4,586,563 | A | * | 5/1986 | Dubrovsky et al. | 165/151 |
| 4,771,825 | A | * | 9/1988 | Chen et al. | 165/151 |
| 5,033,540 | A | * | 7/1991 | Tategami et al. | 165/135 |
| 5,172,761 | A | * | 12/1992 | Lyon | 165/173 |
| 5,195,579 | A | * | 3/1993 | Buchanan | 165/149 |
| 5,236,045 | A | * | 8/1993 | Janezich et al. | 165/183 |
| 5,309,982 | A | * | 5/1994 | Aliano | 165/76 |
| 5,329,988 | A | * | 7/1994 | Juger | 165/153 |
| 5,467,816 | A | * | 11/1995 | Larinoff | 165/151 |
| 5,487,422 | A | * | 1/1996 | Bertva et al. | 165/67 |

(Continued)

FOREIGN PATENT DOCUMENTS

| | | |
|---|---|---|
| FR | 1521637 | 8/1968 |
| FR | 2770633 | 5/1999 |
| JP | 2169177 | 6/1990 |
| JP | 8178556 | 7/1996 |
| JP | 10306993 | 11/1998 |
| JP | 11223477 | 8/1999 |

OTHER PUBLICATIONS

Patent Abstracts of Japan, Pub. No. 10306993, Pub. Date Nov. 17, 1998.
Patent Abstracts of Japan, Pub. No. 11223477, Pub. Date Aug. 17, 1999.
Patent Abstracts of Japan, Pub. No. 02169177, Pub. Date Jun. 29, 1990.
Patent Abstracts of Japan, Pub. No. 08178556, Pub. Date Jul. 12, 1996.

*Primary Examiner*—Henry Bennett
*Assistant Examiner*—Nihir Patel
(74) *Attorney, Agent, or Firm*—Liniak, Berenato & White

(57) ABSTRACT

A heat-exchange module has a main exchanger and at least one secondary exchanger, each having a body with fluid-circulation tubes, and cooling fins, the secondary exchanger being fixed onto the main exchanger. The module includes a set of fins common to the main exchanger and to at least one secondary exchanger, these fins being mounted on the tubes of the main exchanger and projecting from this exchanger, the projecting parts of the fins including cut-outs for accommodating the tubes of the secondary exchanger. Fastenings secure the secondary exchanger in the position in which its tubes are engaged in the cut-outs.

5 Claims, 9 Drawing Sheets

U.S. PATENT DOCUMENTS 5,509,199 A * 4/1996 Beamer et al. ..... 29/890.07
5,725,047 A * 3/1998 Lopez ..... 165/149
5,743,328 A * 4/1998 Sasaki et al. ..... 165/144
6,155,340 A * 12/2000 Folkedal et al. ..... 165/175
6,213,196 B1 * 4/2001 Ozaki et al. ..... 165/140
6,378,204 B1 * 4/2002 Kim et al. ..... 29/890.047
6,382,312 B2 * 5/2002 Avequin et al. ..... 165/140
6,408,939 B1 * 6/2002 Sugimoto et al. ..... 165/140
6,502,305 B2 * 1/2003 Martins et al. ..... 29/890.047
6,523,603 B2 * 2/2003 Uchikawa et al. ..... 165/81

* cited by examiner

HEAT-EXCHANGE MODULE, ESPECIALLY FOR A MOTOR VEHICLE

FIELD OF THE INVENTION

The invention relates to a heat-exchange module, and more particularly such a module comprising a main exchanger and at least one secondary exchanger each including a generally flat body equipped with fluid-circulation tubes, and moreover comprising cooling fins, the secondary exchanger being fixed onto the main exchanger in such a way that the same airflow can pass over the respective bodies of the said exchangers.

BACKGROUND OF THE INVENTION

Such exchangers generally take the form of a body equipped with fluid-circulation tubes and with fins for heat exchange with the outside environment. This body is linked to at least one manifold which distributes the fluid into the circulation tubes.

It is known to assemble one or more secondary exchangers onto a main exchanger, such as a radiator for cooling a motor-vehicle engine, so as to constitute an assembly, also called module, ready to be installed in the vehicle. This secondary exchanger most often consists of a cooler of supercharging air for the engine, an air-conditioning condenser or an oil radiator.

The assembling of the secondary exchanger or exchangers onto the main exchanger is generally achieved by means of lugs integral with the secondary exchanger and of screws inserted into the manifolds of the main exchanger. Systems for assembly by nested fitting or by clipping of the manifolds have also been proposed.

These known assemblies of primary and secondary exchangers exhibit the drawback of requiring operations which are expensive in terms of time and of tooling.

Furthermore, the elements for linking between the main and secondary exchangers take up a certain amount of space which detracts from the compactness of the module.

Moreover, these linking elements exhibit a certain transverse bulk and therefore do not make it possible to have the same exchange surface area available for the main and secondary exchangers.

The present invention aims to remedy these drawbacks.

More particularly, the object of the invention is to supply a heat-exchange module the production of which, and especially the assembling operations, is as simple as possible.

It is also an object of the invention to supply such a heat-exchange module which, as far as possible, includes no assembling pieces between the main and secondary exchangers.

The invention aims, moreover, to supply a method of producing a heat-exchange module requiring no assembly operation or, when that is impossible, including a minimum number of them.

It is also an object of the invention to supply such a heat-exchange module of lesser thickness than those of the prior art.

It is also an object of the invention to supply a heat-exchange module exhibiting enhanced heatexchange characteristics.

SUMMARY OF THE INVENTION

According to one aspect of the invention there is provided heat-exchange module, comprising a main exchanger and at least one secondary exchanger each including a generally flat body equipped with fluid-circulation tubes, and moreover comprising cooling fins, the secondary exchanger being fixed onto the main exchanger in such a way that the same airflow can pass over the respective bodies of the said exchangers, wherein the module includes a set of fins which is common to the main exchanger and to at least one secondary exchanger, the said fins being mounted on the fluid-circulation tubes of the main exchanger and projecting from this exchanger substantially perpendicularly to the plane thereof, the parts of the fins projecting from the main exchanger including cut-outs for accommodating the fluid-circulation tubes of the secondary exchanger, and fastening means being provided in order to fasten the secondary exchanger in the position in which its fluid-circulation tubes are engaged in the said cut-outs.

The exchangers are thus assembled by their body, by means of their fluid-circulation tubes and of the common set of cooling fins.

This results in a simplification of the assembling of the heat-exchange module.

The module may, moreover, feature smaller dimensions. This is because no assembling element projects outside the cross section of the exchangers. Moreover, the bodies may be as close together as desired.

This also results in a lesser thickness for the module, and the possibility, for each exchanger, of having the maximum exchange surface area available.

In one particular embodiment, the cooling fins project from the main exchanger on one side thereof for assembling a secondary exchanger and the main exchanger.

In another embodiment, the cooling fins project from the main exchanger on both sides thereof for assembling two secondary exchangers and the main exchanger.

Advantageously, the cut-outs of the fins are open towards the secondary exchanger.

The expression "fastening means" as used at the moment is generally intended to encompass mechanical means suitable for immobilizing the secondary exchanger or exchangers with respect to the main exchanger.

In one embodiment of the invention, the fastening means comprise force-fitting of the tubes of the secondary exchanger into the cut-outs of the fins.

In another embodiment of the invention, the fastening means comprise shape-interlocking means.

These fastening means may comprise aligned notches formed in one of the sides, which are perpendicular to the planes of the exchangers, of the projecting part of the fins and a fastening element coming from the secondary exchanger and able to be engaged in the said notches.

In one embodiment, the fastening element comprises at least one recess provided on at least one cheek of the secondary exchanger.

In another embodiment, the fastening element comprises at least one lug coming from at least one side of a manifold of the secondary exchanger.

The fastening means may also comprise aligned notches formed in one of the sides, which are perpendicular to the planes of the exchangers, of the projecting part of the fins and an affixed fastening element suitable for being engaged in the said notches.

In one embodiment, this affixed fastening element is a strip equipped with a rib configured so as to be engaged in the said notches, and locking means are provided for securing the fastening element to the secondary exchanger.

Advantageously, the locking means comprise crimping lugs integral with a cheek mounted on the secondary exchanger for crimping the fastening element onto the secondary exchanger.

The fastening means may comprise at least one crosspiece with a U-shaped cross section which features two opposite edges suitable for coming to bear on two opposite faces of the fins and which includes a lug suitable for being engaged in a notch provided in a manifold of the secondary exchanger.

An additional subject of the invention is a method of producing a heat-exchange module comprising a main exchanger and at least one secondary exchanger each including a body equipped with fluid-circulation tubes, and further comprising cooling fins, and in which the secondary exchanger is fixed onto the main exchanger in such a way that the same airflow can pass over the respective bodies of the said exchangers.

In accordance with the invention, the method comprises the stages consisting in producing the main exchanger with fins projecting from this exchanger substantially perpendicularly to the plane thereof, the projecting parts of the fins including cut-outs for accommodating the fluid-circulation tubes of the secondary exchanger, producing the secondary exchanger without cooling fins, positioning the secondary exchanger by engaging its fluid-circulation tubes in the said cut-outs, and fastening the secondary exchanger in this position.

BRIEF DESCRIPTION OF THE DRAWINGS

A number of preferred embodiments of the invention will now be described, by way of non-limiting examples, with reference to the attached diagrammatic drawings, on which.

DESCRIPTION OF THE PREFERRED EMBODIMENTS

In the various figures, like reference signs indicated like parts unless otherwise indicated.

Figure 1:
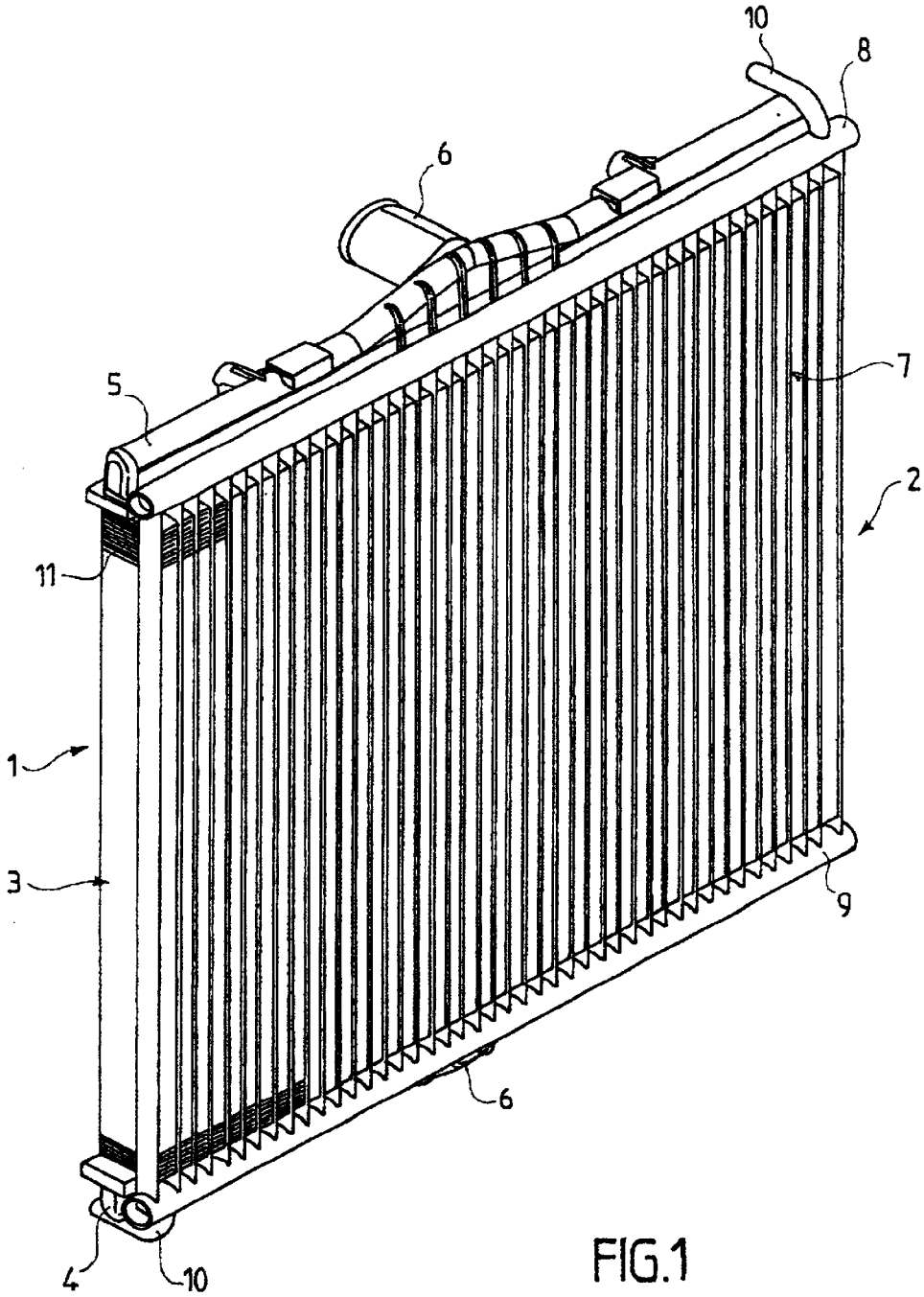
FIG. 1 is a view in perspective of a heat-exchange module according to a first embodiment of the invention.

The heat-exchange module of FIG. 1 is made up of a radiator 1 for cooling a motor-vehicle engine and of an air-conditioning condenser 2, these two exchangers being generally flat.

The radiator 1 is made up in a known way from a body 3 produced from a bank of vertical fluid-circulation tubes and mounted between two manifolds 4 and 5, the manifolds being arranged along two parallel sides of the body and being equipped with cooling-fluid inlet and outlet pipes 6.

The condenser 2 is also made up of a body 7 produced from a bank of vertical fluid-circulation tubes and mounted between two manifolds 8 and 9, the manifolds being arranged along two parallel sides of the body and equipped with refrigerant-fluid inlet and outlet pipes 10.

It will be seen later that the heat exchangers 1 and 2 are assembled by their body 3 and 7 respectively, by way of fins 11 common to the two exchangers.

Figure 2:
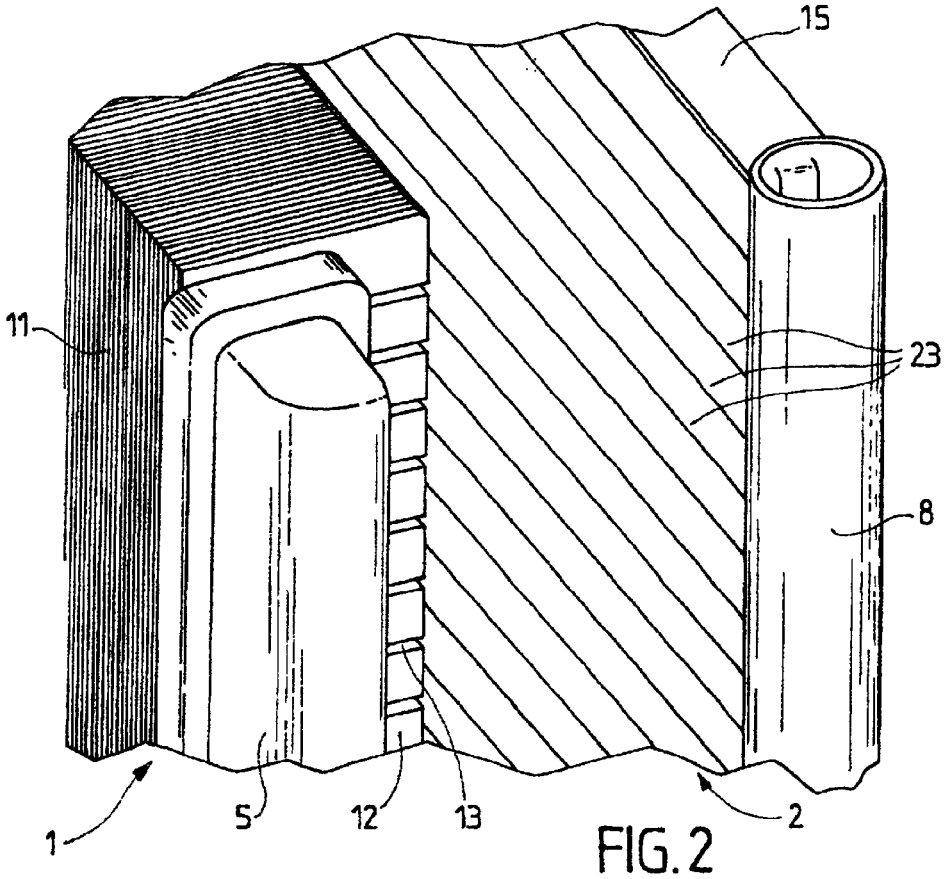
FIG. 2 is a view in exploded perspective, on a larger scale, of a part of the module of FIG. 1 before assembling.
Figure 3:
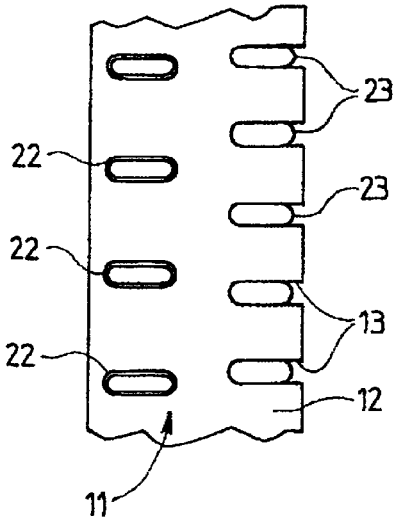
FIG. 3 is a partial view showing the tubes of the secondary exchanger engaged in the notches of the fins after assembling.

These fins 11, represented better in FIGS. 2 and 3, are mounted in a conventional way onto the tubes 22 of the body 3 of the heat exchanger 1.

However, they include the particular feature of including projecting extensions 12, perpendicularly to the plane of the exchangers, on the heat-exchanger 2 side.

The extensions 12 include cut-outs 13 open towards the exchanger 2. These cut-outs have a shape corresponding to the cross section of the tubes 23 of the exchanger 2, which here are flat tubes, and the same pitch as these tubes, so as to accommodate these tubes (FIG. 3).

In the embodiment of FIGS. 1 to 3, the tubes 23 of the secondary exchanger 12 are assembled by force into the cut-outs 13 of the fins. This provides fastening by friction between the walls of the tubes 23 and the edges of the cut-outs 13.

Moreover, the exchanger 2 comprises two lateral cheeks 15 along its sides perpendicular to the manifolds 8 and 9 (FIG. 2). These cheeks may, if appropriate, bear forcibly against the sides of the fins in order to contribute to holding the secondary exchanger.

The assembling of the exchanger 1 equipped with its fins 11 with the exchanger 2 devoid of fins then takes place in the following way. The exchanger 2 is simply pressed against the exchanger 1 forcibly engaging the tubes 23 of the exchanger 2 into the cut-outs 13 of the extensions 12 of the fins, which fastens the exchanger 2.

Figure 4:
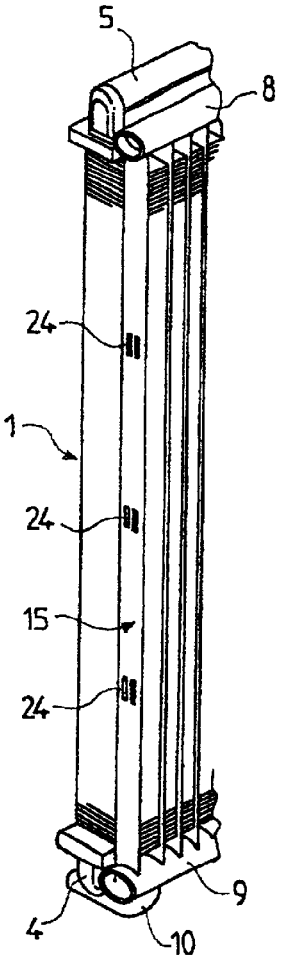
FIG. 4 is a partial view in perspective of a heat-exchange module according to a second embodiment of the invention.
Figure 5:
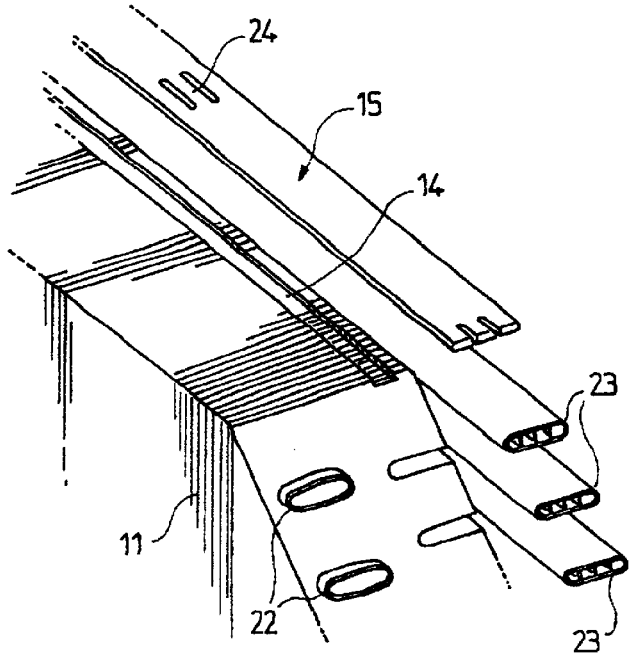
FIGS. 5 and 6 are two partial views in perspective illustrating the assembling of the module of FIG. 4.
Figure 6:
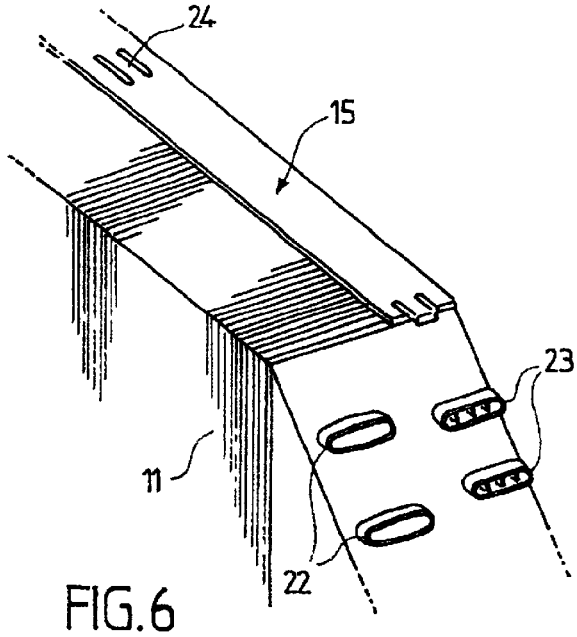

The heat-exchange module of FIGS. 4 to 6 is similar to that of FIGS. 1 to 3. However, the fastening of the secondary exchanger 2 with respect to the main exchanger 1 takes place here by shape-interlocking means. To that end, each extension 12 of the fins furthermore includes a notch 14 formed in each of its sides perpendicular to the planes of the exchangers (FIG. 5). The notches 14 are aligned in such a way as to form two opposite vertical grooves in the fin unit.

The secondary exchanger 2 includes two lateral cheeks 15 similar to those of the embodiment of FIGS. 1 to 3. However, at least one of the cheeks 15 comprises recesses 24, here three in number (FIG. 4), which are turned to the same side as the fins and intended to be engaged by shape interlocking in the notch 14. Thus fastening is ensured here by an element coming from the secondary exchanger.

The module is assembled by pressing the exchanger 2 against the exchanger 1 (FIGS. 5 and 6) in such a way as to engage the tubes 23 of the exchanger 2 in the cut-outs 13 of the extensions 12 of the fins. Next, the recesses 24, which are preferably pre-cut-out, are deformed in the direction of the notch 14 in order to provide the fastening.

Figure 7:
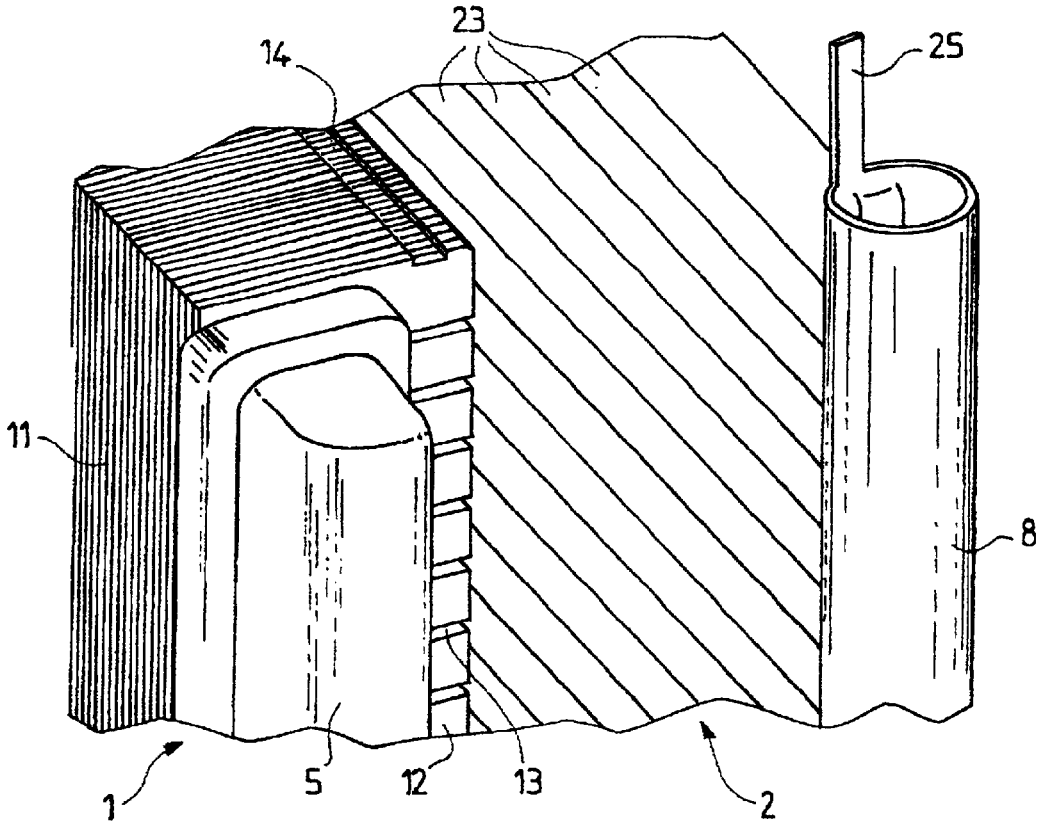
FIGS. 7 and 8 are two partial views in perspective illustrating the assembling of a module according to a third embodiment of the invention.
Figure 8:
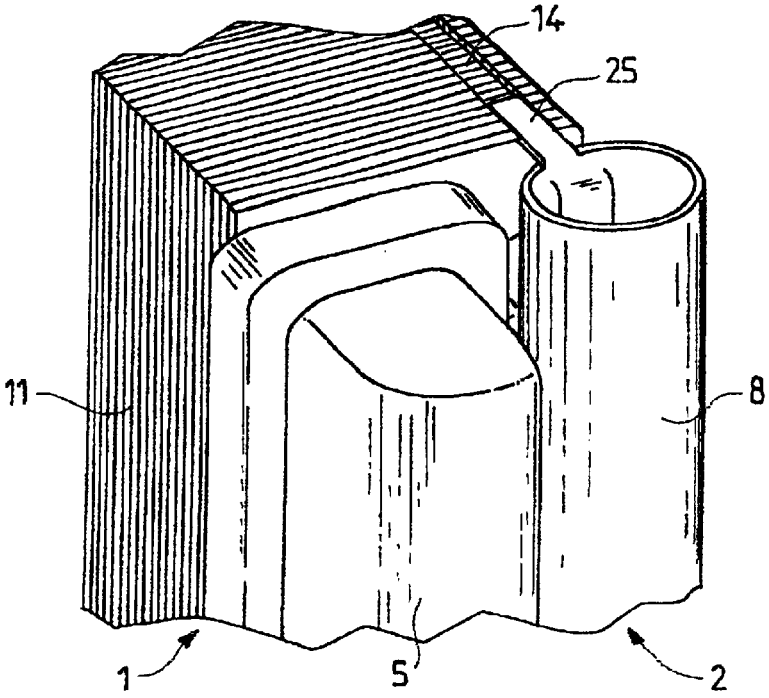
Figure 9:
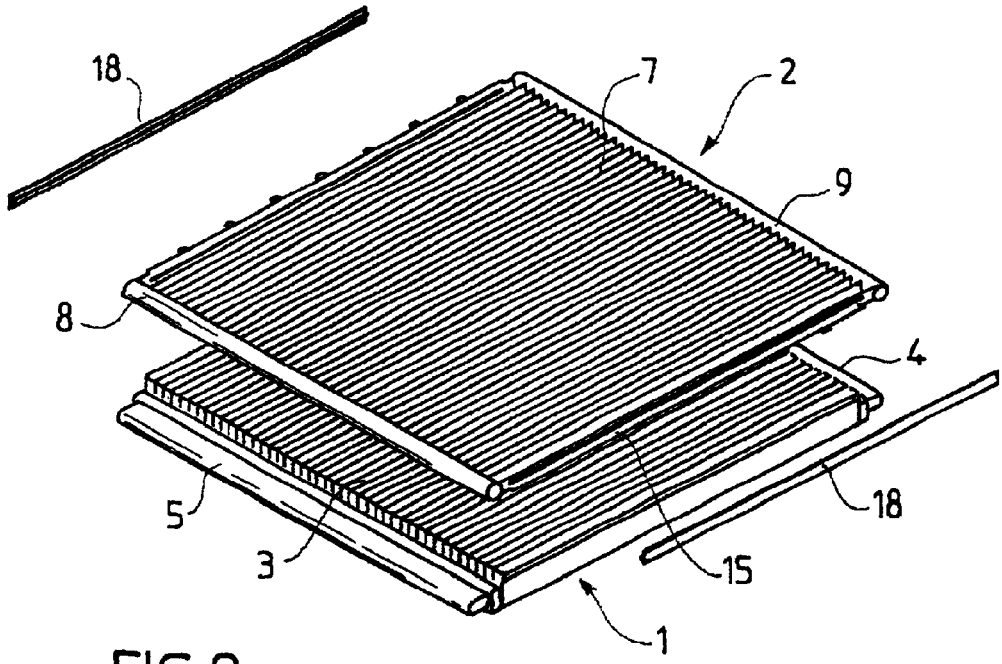
FIGS. 9 and 10 are two views in perspective illustrating the assembling of a module according to a fourth embodiment of the invention.

The heat-exchange module of FIGS. 7 and 8 is similar to that of FIGS. 4 to 6, and the fastening of the secondary exchanger 2 with respect to the main exchanger 1 is also carried out by shape-interlocking means.

The extension 12 of the fins here includes two notches 14, similar to those of the embodiment of FIGS. 4 to 6, in such a way as to form two opposite vertical grooves in the fin unit.

The exchanger 2 comprises a fastening element which is formed from at least one lug 25 coming from at least one side of a manifold 8 of the heat exchanger 2. The two manifolds 8 and 9 of the exchanger 2 are preferably each equipped with two lugs 25 which gives rise to four lugs in all.

The module is assembled by pressing the exchanger 2 against the exchanger 1 (FIGS. 7 and 8) so as to engage the tubes 23 of the exchanger 2 in the cut-outs 13 of the extensions 12 of the fins. Next, each of the lugs 25 is folded so as to be engaged in a notch 14 so as to provide the fastening.

The heat-exchange module of FIGS. 9 to 13 is similar to that of FIGS. 4 to 6 and to that of FIGS. 7 and 8, in the sense that the fastening of the secondary exchanger 2 with respect to the main exchanger 1 also takes place by shape-interlocking means.

The extension 12 of the fins also includes two notches 14 (FIG. 11) which are similar to those described above.

Figure 11:
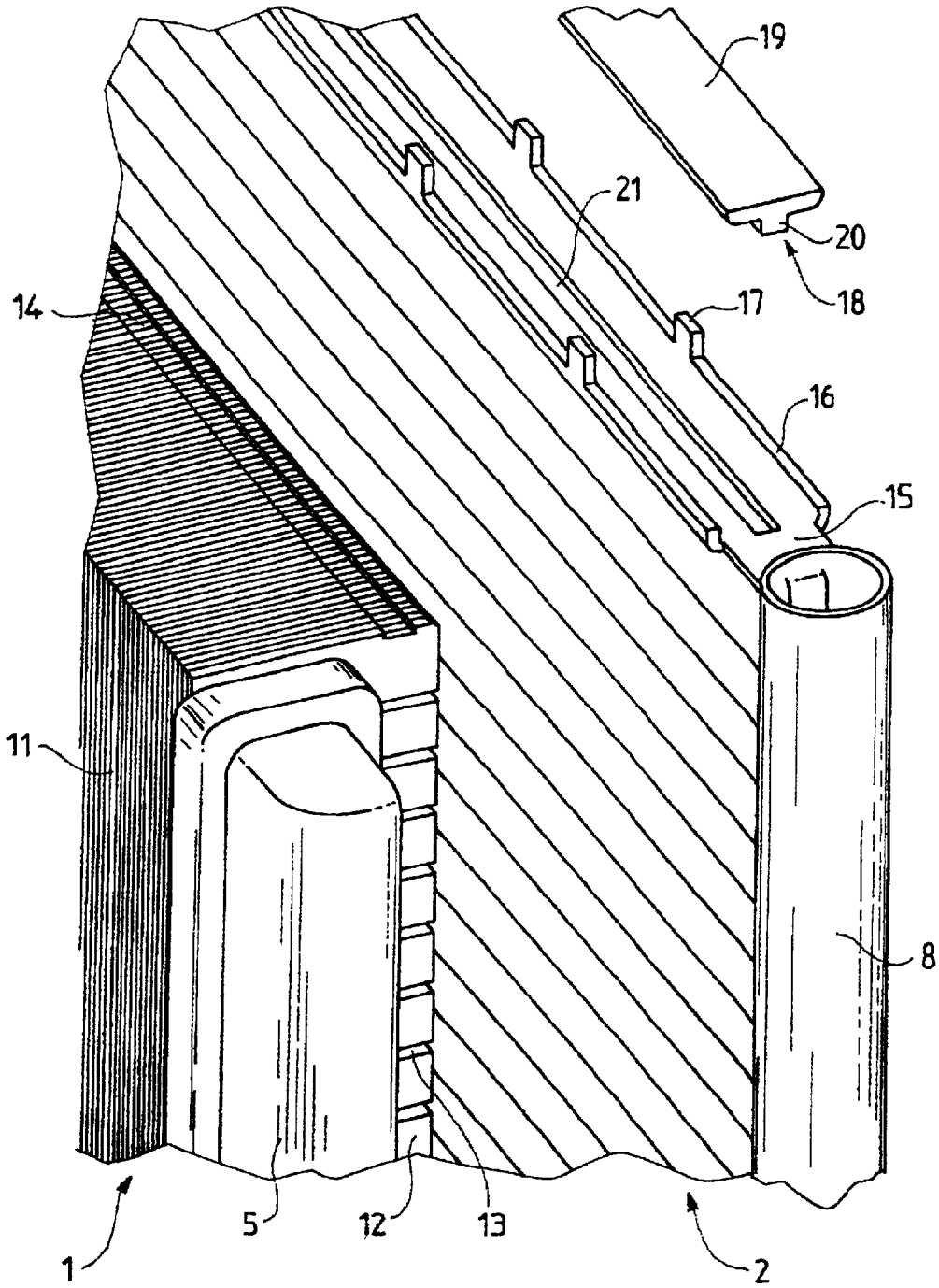
FIG. 11 is a view in exploded perspective, on a larger scale, of a part of the module of FIGS. 9 and 10, before assembling.
Figure 12:
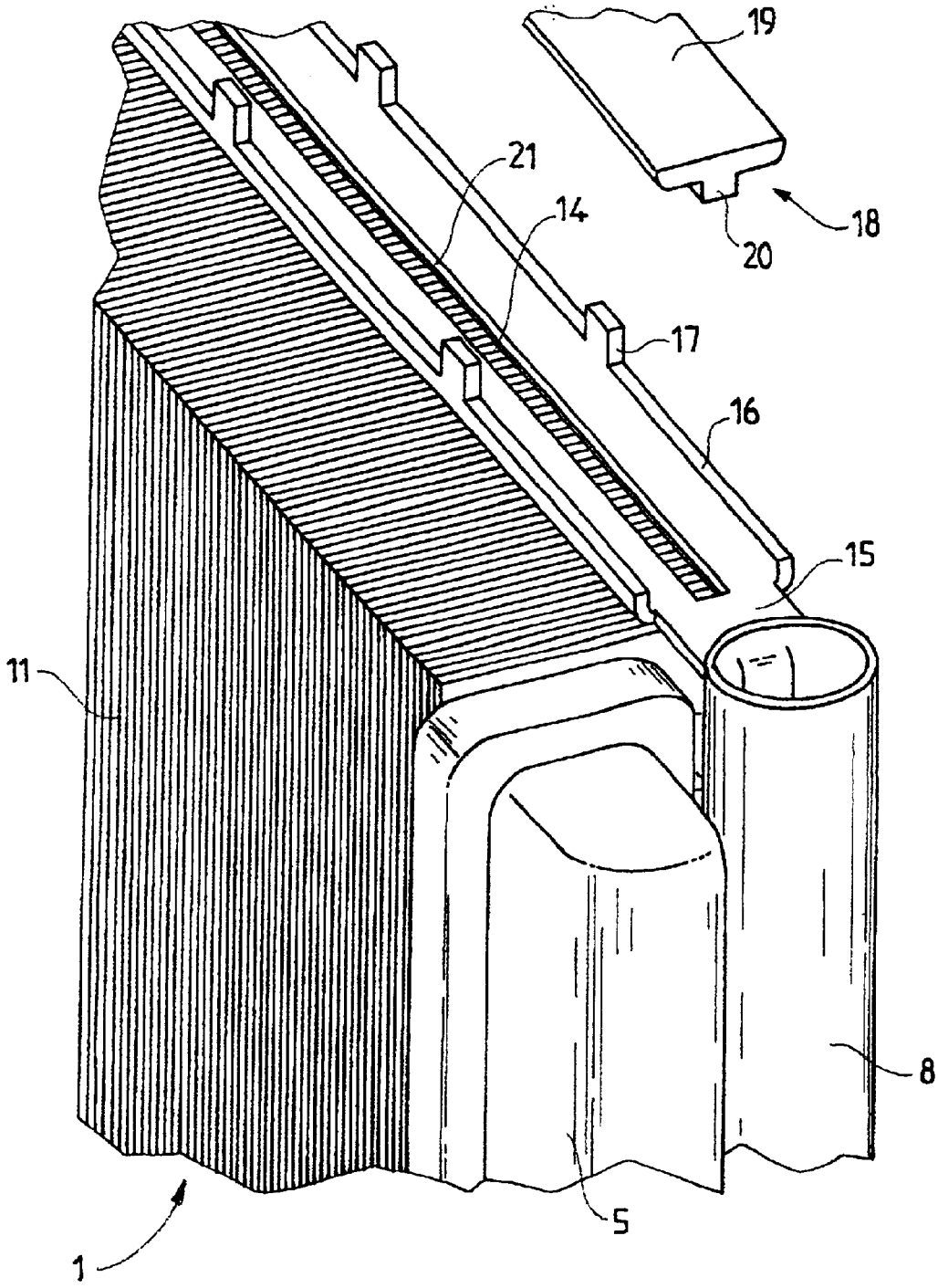
FIG. 12 is a view similar to FIG. 11 showing the module in the course of assembling.
Figure 13:
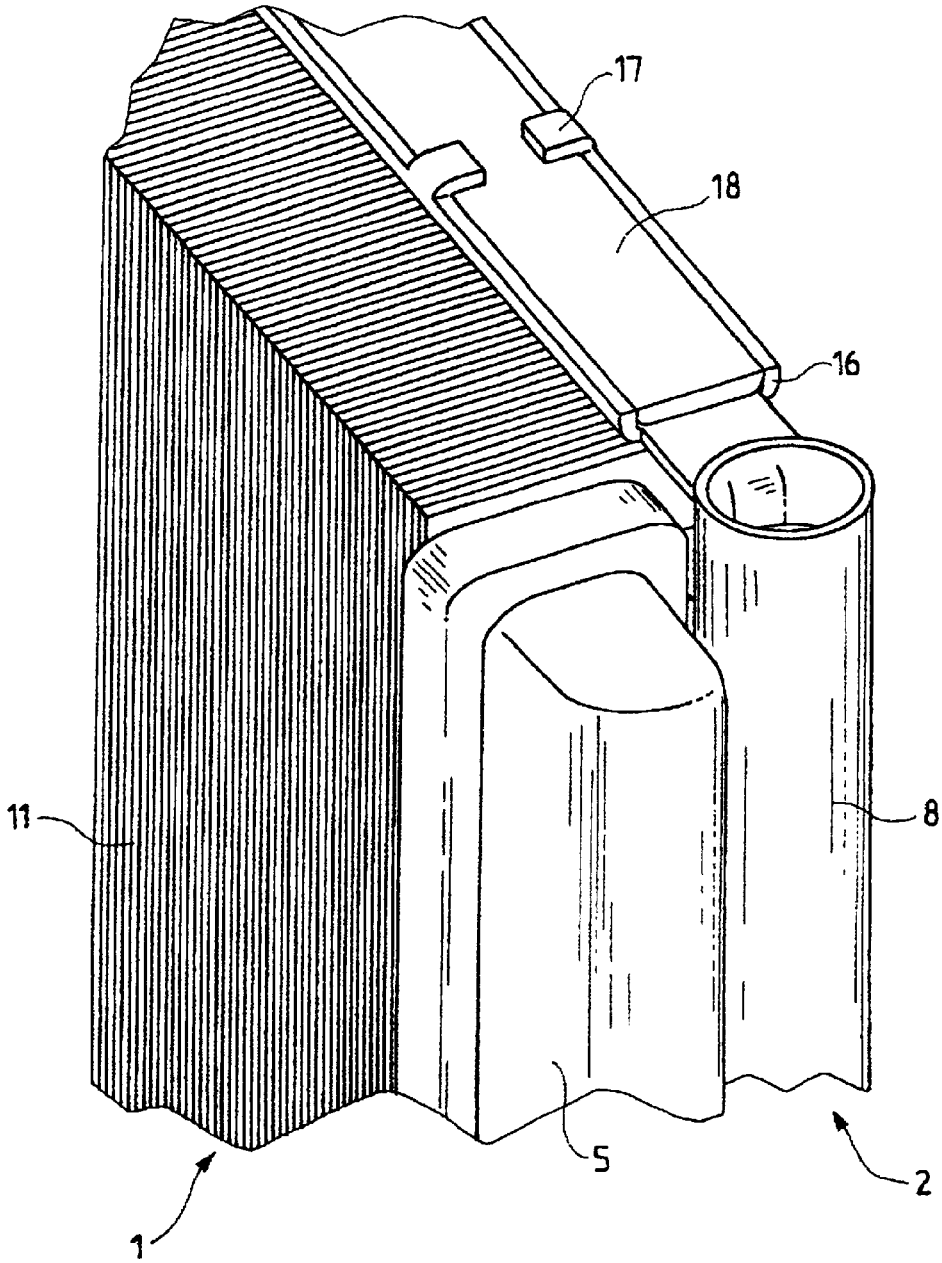
FIG. 13 is a view similar to FIG. 11 showing the module assembled.

The cheeks 15 of the exchanger 2 each include two rims 16 projecting towards the outside of the exchanger, these rims 16 themselves being extended by crimping lugs 17 (FIGS. 11 to 13).

A fastening strip 18, consisting, for example, of a segment of plastic sectional bar, is provided, moreover, to interlock with each of the cheeks 15. This strip constitutes a fastening element which is affixed, and does not come from the exchanger 2. Each strip has a substantially T-shaped cross section. It comprises a body 19 of a width substantially equal to the distance between the two rims 16, and a thickness substantially equal to the height of the rims 16.

Moreover, it comprises a rib 20 of the same cross section as the notches 14. The dimensions of the strip 18 are such that it can be engaged between the rims 16 with the rib 20 in the notches 14. To that end, the cheeks 15 include a slot 21 allowing the rib 20 to pass through.

The exchanger 1 equipped with its fins 11 is thus assembled with the exchanger 2, devoid of fins, in the following way.

The exchanger 2 is first of all pressed against the exchanger 1 by engaging the tubes 23 of the exchanger 2 in the cut-outs 13 of the extensions 12 of the fins. In this position, the slot 21 is face to face with the notches 14 (FIG. 12).

The strip 18 is then put in place between the rims 16 and in the slot 21 and the notches 14.

Figure 10:
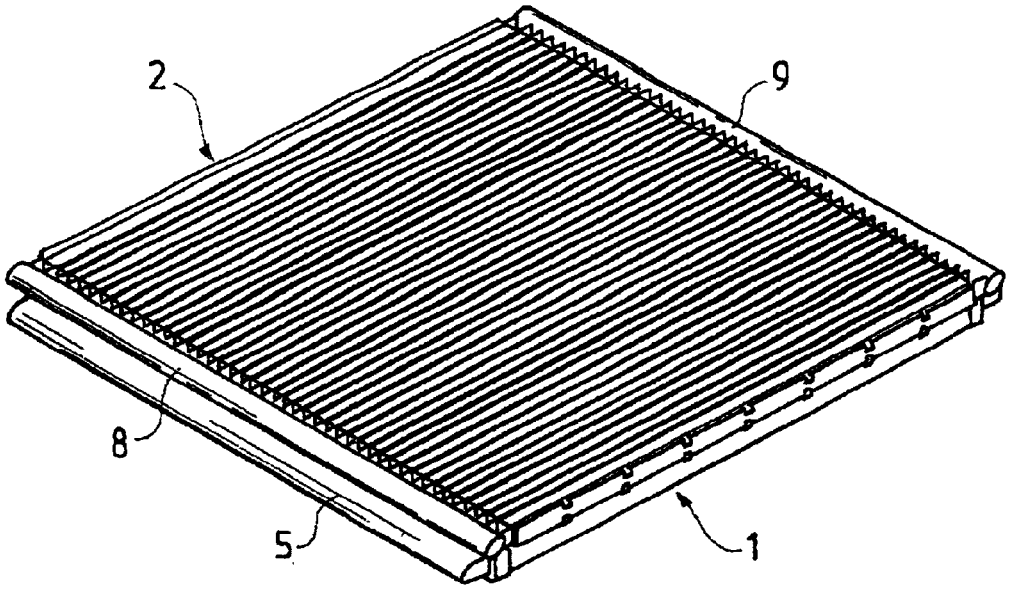

Finally, the lugs 17 are crimped onto the strip 18 so as to immobilize it (FIGS. 10 and 13). The exchanger 2 is thus secured to the exchanger 1.

Figure 14:
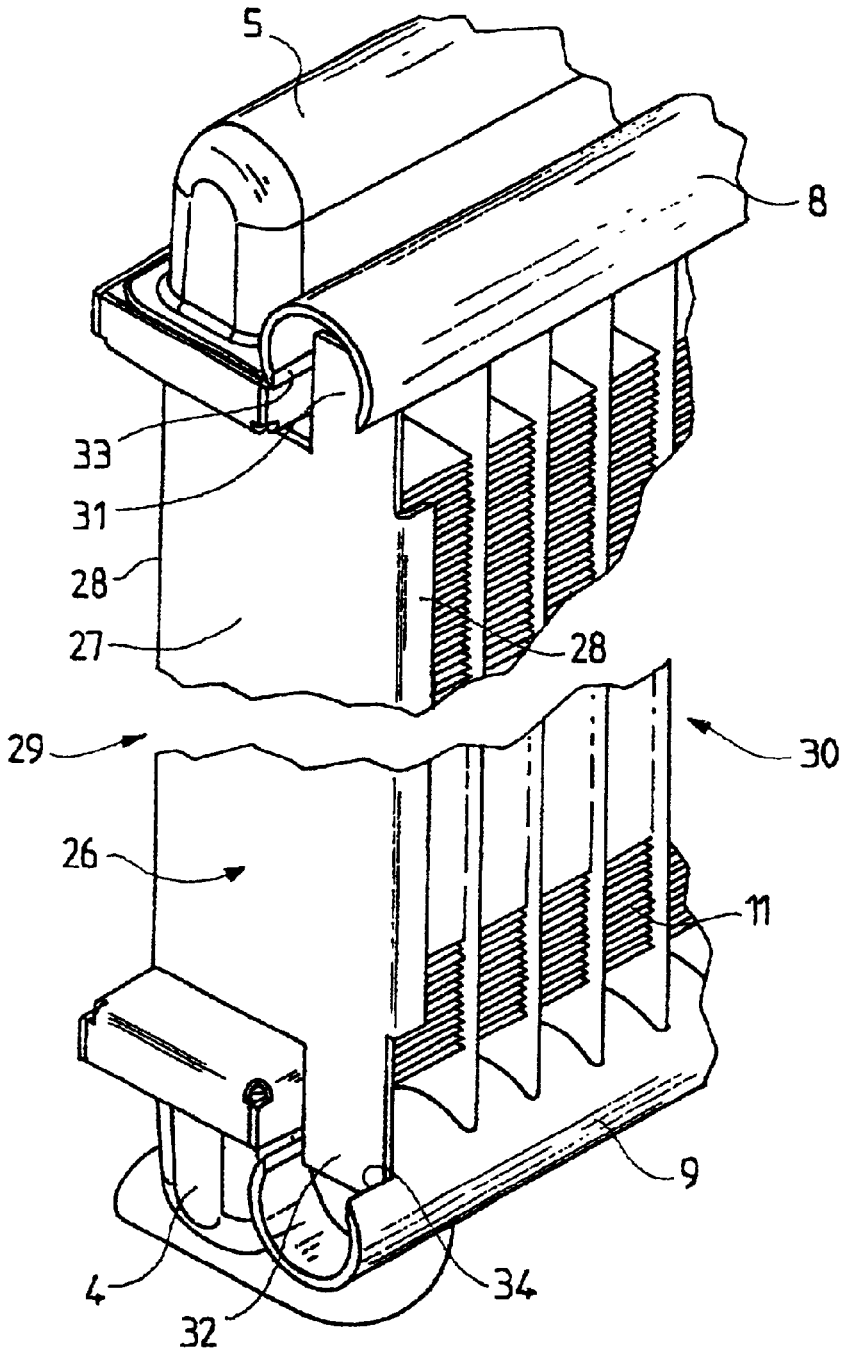
FIG. 14 is a partial view in perspective of a heat-exchange module according to a fifth embodiment of the invention.

In the heat-exchange module of FIG. 14, the fastening of the secondary exchanger 2 with respect to the main exchanger 1 also takes place by shape-interlocking means.

These fastening means comprise at least one crosspiece 26 with a U-shaped cross section which exhibits a generally flat web 27 lying between two opposite edges 28. These edges are able to come to bear against two opposite faces 29 and 30 of the fins which respectively constitute the two main faces of the module. The module preferably comprises two crosspieces 26.

Each crosspiece here includes two lugs 31 and 32, each able to be engaged in a notch 33 or 34 respectively, provided in the manifold 8 or 9 respectively of the secondary exchanger.

The invention is not limited to the embodiments described above and extends to other variants. Thus, although a single secondary exchanger is envisaged here, it would always be possible to provide a second one by adopting the same configuration as described above on the side opposite that of the exchanger 2. To do that, it would be sufficient to extend the fins 11 on the other side of the plane of the exchanger 1.

The core of the exchanger 1 can be formed from any type of tubes, flat or circular in cross section. It may also have one or more layers.

What we claim is:

1. A heat-exchange module, comprising a main exchanger and at least one secondary exchanger each including a generally flat body equipped with first and second fluid-circulation tubes, respectively, and moreover comprising cooling fins, the secondary exchanger being fixed onto the main exchanger in such a way that the same airflow can pass over the respective bodies of said main and secondary exchangers, wherein the cooling fins are common to the main exchanger and to said at least one secondary exchanger, said cooling fins being mounted on the first fluid-circulation tubes of the main exchanger and projecting from this exchanger substantially perpendicularly to the plane thereof, the parts of the cooling fins projecting from the main exchanger including cut-outs for accommodating the second fluid-circulation tubes of the secondary exchanger, and fastenings being provided in order to fasten the secondary exchanger in the position in which said second fluid-circulation tubes are engaged in said cut-outs.

2. The heat-exchange module of claim 1, in which the cooling fins project from the main exchanger on one side thereof for assembling said at least one secondary exchanger and the main exchanger.

3. The heat-exchange module of claim 1, in which the cut-outs of the cooling fins are open towards the at least one secondary exchanger.

4. The heat-exchange module of claim 1, in which the fastenings comprise force-fitting of the second fluid-circulation tubes of the at least one secondary exchanger into the cut-outs of the cooling fins.

5. A method of producing a heat-exchange module according to claim 1, comprising a main exchanger and at least one secondary exchanger each including a body equipped with first and second fluid-circulation tubes, respectively, and moreover comprising cooling fins, and in which the secondary exchanger is fixed onto the main exchanger in such a way that the same airflow can pass over the respective bodies of said main and secondary exchangers, the method comprising:

producing the main exchanger with said cooling fins projecting from this exchanger substantially perpendicularly to the plane thereof, the projecting parts of the cooling fins including cut-outs for accommodating the second fluid-circulation tubes of the secondary exchanger;

producing the secondary exchanger without said cooling fins, positioning the secondary exchanger by engaging said second fluid-circulation tubes in said cut-outs; and fastening the secondary exchanger in this position.

* * * * *